US005979718A

United States Patent [19]

Jinathan

[11] Patent Number: 5,979,718

[45] Date of Patent: Nov. 9, 1999

[54] DEVICE FOR SPILLAGE PREVENTION DURING POURING WINE AND THE LIKE

[76] Inventor: Levine Jinathan, Via Fam Valentino 19, Rome, Italy

[21] Appl. No.: 09/019,597

[22] Filed: Feb. 6, 1998

[51] Int. Cl.[6] ..... B65D 5/72

[52] U.S. Cl. ..... 222/567; 222/566; 222/569; 222/571

[58] Field of Search ..... 222/566, 569, 222/567, 574, 571, 530; 141/337, 338, 390, 391

[56] References Cited

U.S. PATENT DOCUMENTS

| | | | |
|---|---|---|---|
| 2,193,805 | 3/1940 | Deschner | 222/566 |
| 2,678,142 | 5/1954 | Creed | 222/566 |
| 4,222,504 | 9/1980 | Ackerman | 222/569 |
| 5,651,481 | 7/1997 | Jensen | 222/566 |

*Primary Examiner*—Kevin P. Shaver
*Assistant Examiner*—David Deal
*Attorney, Agent, or Firm*—Ilya Zborovsky

[57] ABSTRACT

A device for preventing spillage of wine, liquor, etc. during their pouring from a bottle and the like, the device has a springy element which is movable between a substantially flat inoperative position and a wound operative position so that in the wound operative position it is formed as a tube insertable into a neck of a bottle and the like and firmly abuts, due to its springy nature, against an inner surface of the bottle, to form a tubular guide for pouring wine, liquor, etc.

5 Claims, 2 Drawing Sheets

DEVICE FOR SPILLAGE PREVENTION DURING POURING WINE AND THE LIKE

BACKGROUND OF THE INVENTION

The present invention relates to a device for preventing spillage of wine, liquor and the like, when the wine, liquor and the like is poured from a bottle into glasses and the like.

It is well known that when the above specified beverages are poured from bottles into the glasses, they are usually spilled from a neck of the bottle on surrounding objects such as table cloth, furniture, carpets, etc. It is therefore desirable to avoid spillage as much as possible for preventing contamination of surrounding objects as well as for saving the beverages themselves.

SUMMARY OF THE INVENTION

Accordingly, it is an object of the present invention, to provide a device which reliably prevents spillage of wine, liquor, etc. during its pouring from a bottle.

In keeping with these objects and with others which will become apparent hereinafter, one feature of present invention resides, briefly stated in a device for preventing spillage of wine, etc., which is formed as a spring element movable between a first inoperative position in which it is substantially flat, and a second operative position in which it is wound to form a tube insertable into a neck opening of a bottle and the like and held in the neck opening under the action of its springy properties, so as to at least partially extend outwardly beyond the bottle and the like and therefore guide wine, etc. from the interior of the bottle through the tube, and outwardly into a glass and the like.

When the device is designed and utilized in accordance with present invention, spillage of wine, liquor, etc. is reliably prevented.

In accordance with one embodiment of the invention, the springy element is substantially round in its flat inoperative position so that in the operative position it forms an inlet ramp for entering wine, liquor, etc. into the pipe and an outlet ramp for flowing of wine, liquor, etc. outwardly from the tube.

In accordance with still another feature of present invention, the springy element is provided with a rearward projection extending rearwardly from a main part from the springy element, so that when the springy element assumes its operative position, the projection forms an extended part which extends further into the bottle to facilitate flowing of the wine, liquor, etc. into the device in its operative position when it is wound into the tube.

In accordance with a further advantageous feature of present invention, the springy element has a portion provided with at least one opening (perforation), so that when the springy element is bent, the portion provided with the opening bridges a neck opening of the bottle, and wine, liquor etc flows through the perforated portion, whereby any mechanical impurities in wine are retained in the bottle and not poured together with, liquor, etc into a glass, etc.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 7 is a view showing the device of FIG. 6 in an operative position inserted in the neck of the bottle and the like.

DESCRIPTION OF PREFERRED EMBODIMENTS

Figure 1:
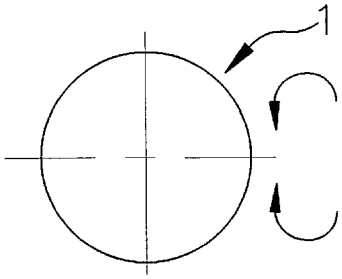
FIGS. 1 and 2 are views showing a device for preventing spillage in accordance with present invention in an inoperative position and in an operative position respectively.
Figure 2:
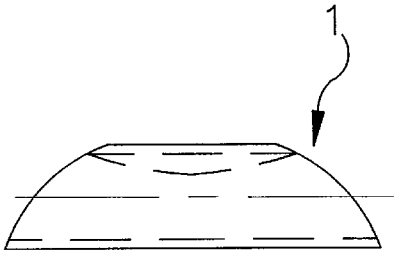

Device for preventing spillage of wine, liquor, etc. during pouring from a bottle into a glass and the like is formed as a spring element identified as a whole with reference numeral 1. The spring element 1 in an inoperative position is formed as a flat disk, as shown in FIG. 1, composed of a springy material. The term "springy" material is used here to identify a material which can be wound, and after winding retains springy properties so that it springs back to unwind. The spring element 1 of FIG. 1 can be converted into an operative position shown in FIG. 2. In this position it is wound so as to form a tube.

Figure 3:
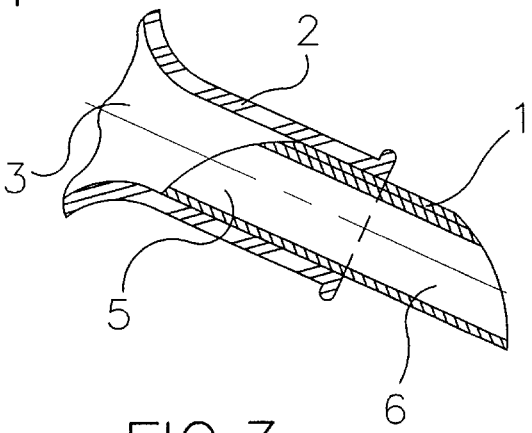
FIG. 3 is a view showing the inventive device inserted in a neck of a bottle for pouring wine, liquor, etc.
Figure 4:
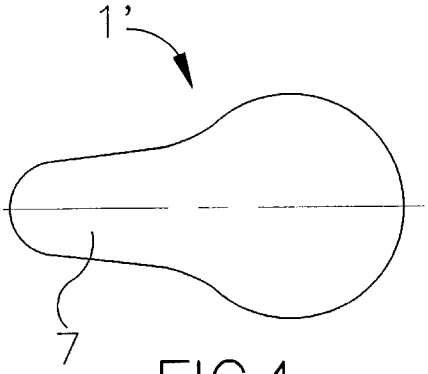
FIGS. 4 and 5 are views substantially corresponding to the views of FIGS. 1 and 2 but showing another embodiment of the device in accordance with present invention.
Figure 5:
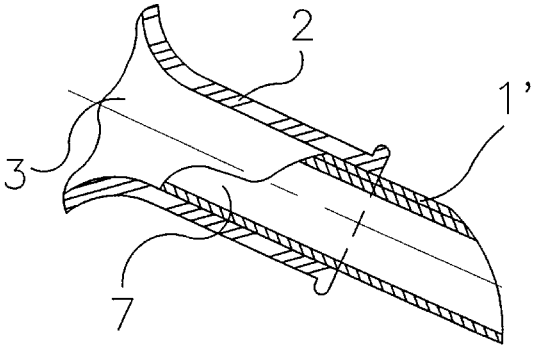

As can be seen from FIG. 3, when the thusly formed tube is inserted into a neck 2 of a bottle 3, it forms a guide for wine, liquor, etc. and therefore during pouring of these beverages they no longer spill from the neck onto surrounding objects. It is to be understood that, as can be seen from FIG. 3, the wound spring element 1 is inserted in the neck 2 so that one part of it projects inside the bottle and the other part projects outside of the bottle 3.

In accordance with a preferable embodiment of the invention, the spring element 1 is formed as a circular disk, as shown in FIG. 1. With this construction when the spring element 1 is wound to its operative position shown in FIG. 2, an inlet ramp 5 and an outlet ramp 6 are formed in the tube. The inlet ramp 5 facilitates flowing of wine, liquor, etc. into the tube, while the outlet ramp 6 facilitates guiding of the beverage flowing out of the tube into a glass, etc.

The device in accordance with another embodiment of the present invention is identified with reference numeral 1'. This device is also formed as a spring element which is movable between the flat inoperative position and tubular operative position. The spring element 1' of this embodiment is provided with a rear projection 7. In the operative position when the spring element 1' is inserted in the neck of the bottle, the projection 7 forms a long extension which extends into the interior of the bottle and the like. Therefore, flowing of wine, liquor, into the tube is further facilitated since these beverages can be guided into the tube earlier, therefore providing a directional and orderly flow.

Figure 6:
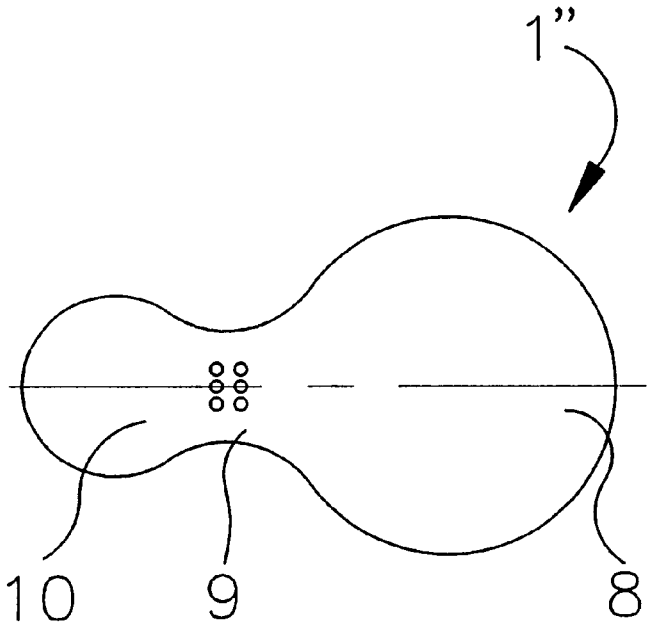
FIG. 6 is a view showing a device in accordance with a third embodiment of the present invention, in an inoperative position.
Figure 7:
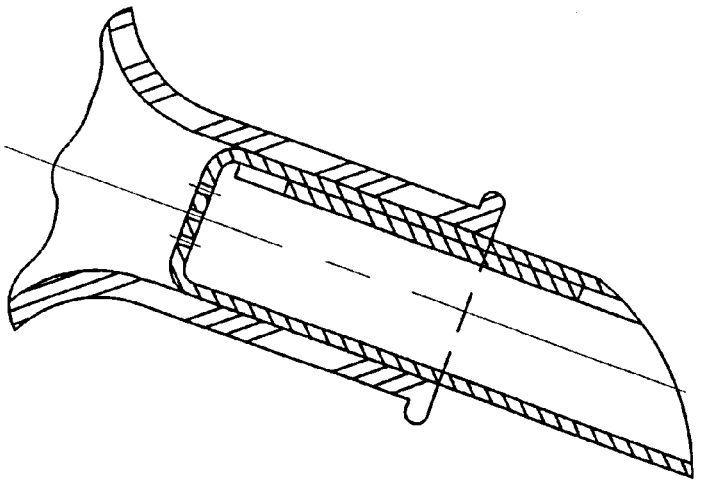

Another embodiment of the present invention is shown in FIGS. 6 and 7. In this embodiment, the spring element 1" has a main part which is identified with reference numeral 8, and intermediate part which is identified with reference numeral 9, and an end part which is identified with reference numeral 10. In accordance with this embodiment, the part 9 is provided with one opening, or preferably a plurality of very small openings or perforations. When the spring element 1 is converted from its flat inoperative position to its wound operative position, the portion 9 is located transversely to the outlet opening of the neck 2 of the bottle 3 thus preventing a full flow of wine, liquor, etc. from the bottle. These beverages can flow only through small opening or openings through the part 9. Therefore impurities in the wine such as pieces of cork, particles due to deterioration of wine, etc. are retained in the bottle and not poured into a glass or the like. In the wound operative position the parts 8 and 10 are wound over one another so as to again form a tube for guiding wine, liquor, etc. from the bottle and the like into a glass and the like.

It will be understood that each of the elements described above, or two or more together, may also find a useful application in other types of constructions differing from the types described above.

While the invention has been illustrated and described as embodied in device for spillage prevention during pouring wine and the like, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for preventing spillage of wine, liquor, etc. during their pouring from a bottle, the device comprising a springy element which is movable between a substantially flat inoperative position and a wound operative position so that in said wound operative position it is formed as a tube insertable into a neck of a bottle and firmly abuts, due to its springy nature, against an inner surface of the bottle, to form a tubular guide for pouring wine, liquor, etc., said springy element having a portion provided with at least one small opening, so that in said operative position said portion extends transversely to a neck of a bottle to close an opening of the neck so that wine, liquor, etc. can flow only through said small opening of said portion of said spring element, therefore retaining impurities inside the bottle.

2. A device as defined in claim 1, wherein said springy element in said inoperative position is formed as a circular disk so that in said operative position it forms an inlet ramp for entering wine, liquor, etc. into the tube and an outlet ramp for pouring wine, liquor, etc. from the tube into the glass or the like.

3. A device as defined in claim 1, wherein said springy element is provided with a rear projection extending from a main part of said spring element, so that in said operative position said projection forms a long extension extending into an interior of the bottle and the like to facilitate flowing of wine, liquor, etc. into the tube.

4. A device as defined in claim 1, wherein said portion of said spring element is provided with a plurality of such small openings.

5. A device as defined in claim 1, wherein said spring element has a main portion and an end portion, said first mentioned portion provided with at least one small opening being located between said main portion and said end portion, while said main portion and said end portion are arranged to embrace one another in said operative position.

* * * * *